US009420894B2

(12) United States Patent
Thurow

(10) Patent No.: US 9,420,894 B2
(45) Date of Patent: Aug. 23, 2016

(54) CONVERTIBLE SEAT/BED HAVING NONCOPLANAR BED BASE SECTIONS

(71) Applicant: FLEXSTEEL INDUSTRIES, INC., Dubuque, IA (US)

(72) Inventor: Jerry Thurow, Dubuque, IA (US)

(73) Assignee: FLEXSTEEL INDUSTRIES INC., Dubuque, IA (US)

( * ) Notice: Subject to any disclaimer, the term of this patent is extended or adjusted under 35 U.S.C. 154(b) by 0 days.

(21) Appl. No.: 14/290,129

(22) Filed: May 29, 2014

(65) Prior Publication Data

US 2014/0352057 A1 Dec. 4, 2014

Related U.S. Application Data

(60) Provisional application No. 61/828,450, filed on May 29, 2013.

(51) Int. Cl.

| | |
|---|---|
| ***A47C 17/165*** | (2006.01) |
| ***A47C 17/04*** | (2006.01) |
| ***A47C 17/16*** | (2006.01) |
| ***A47C 17/13*** | (2006.01) |
| ***A47C 17/207*** | (2006.01) |

(52) U.S. Cl.

CPC ..... *A47C 17/165* (2013.01); *A47C 17/04* (2013.01); *A47C 17/136* (2013.01); *A47C 17/16* (2013.01); *A47C 17/2076* (2013.01)

(58) Field of Classification Search

CPC .. A47C 17/04; A47C 17/165; A47C 17/1655; A47C 17/32; A47C 17/16; A47C 17/162; A47C 17/20; A47C 17/207; A47C 17/2073; A47C 17/2076

USPC ..... 5/28, 29, 31, 37.1, 43, 44.1

See application file for complete search history.

(56) References Cited

U.S. PATENT DOCUMENTS

| | | | | |
|---|---|---|---|---|
| 1,734,214 | A | | 11/1929 | Jones |
| 2,247,546 | A | * | 7/1941 | Donoho ..... 297/111 |
| 2,307,908 | A | * | 1/1943 | Campbell ..... 5/18.1 |
| 2,328,411 | A | * | 8/1943 | Bergstrom ..... A47C 17/2076 5/21 |
| 2,514,798 | A | * | 7/1950 | Rowe ..... B60N 2/34 297/102 |
| 2,937,384 | A | * | 5/1960 | Fossum ..... 5/18.1 |
| 3,165,350 | A | | 1/1965 | Willson |
| 3,385,631 | A | * | 5/1968 | Gertler ..... 297/111 |
| 3,798,683 | A | * | 3/1974 | Alembik ..... 5/13 |
| 3,863,280 | A | | 2/1975 | Mizelle |
| 3,955,846 | A | | 5/1976 | Murphy |
| 4,054,956 | A | | 10/1977 | Quakenbush |
| 4,110,855 | A | | 9/1978 | Acker |
| 4,169,295 | A | | 10/1979 | Darling |
| 4,170,800 | A | * | 10/1979 | Wiberg ..... 5/45 |
| 4,204,287 | A | * | 5/1980 | Lane et al. ..... 5/18.1 |
| 4,221,428 | A | * | 9/1980 | Bowman et al. ..... 297/110 |
| 4,402,096 | A | * | 9/1983 | Atimichuk ..... A47C 17/1753 5/17 |
| 4,442,556 | A | | 4/1984 | Craigie |

(Continued)

*Primary Examiner* — Nicholas Polito
*Assistant Examiner* — David R Hare
(74) *Attorney, Agent, or Firm* — Ladas & Parry LLP

(57) ABSTRACT

A convertible seating unit has noncoplanar sleeper-base sections. A mid-seat deck is highest, a back deck slightly lower and a seat deck considerably lower. The relative heights of the decks and corresponding thicknesses of their respective cushions provide a sleeping support surface for comfortably supporting a person's mass. With the unit in the sleeping configuration, the mid-seat deck is highest and its cushion thinnest (relative to those of the seat deck and back decks), and the seat deck is lowest and its cushion thickest.

16 Claims, 8 Drawing Sheets

(56) References Cited

U.S. PATENT DOCUMENTS

| | | | | | |
|---|---|---|---|---|---|
| 4,543,675 | A * | 10/1985 | Shrock | A47C 17/161 | 5/18.1 |
| 4,620,335 | A | 11/1986 | Dodgen | | |
| 4,625,346 | A | 12/1986 | Quackenbush | | |
| 4,625,347 | A | 12/1986 | McElmurry et al. | | |
| 4,672,696 | A * | 6/1987 | Horenkamp | 5/17 | |
| 4,750,222 | A | 6/1988 | Quakenbush | | |
| 4,869,541 | A | 9/1989 | Wainwright | | |
| 5,195,194 | A * | 3/1993 | Bradley | A47C 17/1756 | 5/37.1 |
| 5,528,778 | A * | 6/1996 | Shrock | A47C 17/1756 | 5/37.1 |
| 5,743,594 | A * | 4/1998 | Suskey et al. | 297/354.13 | |
| 5,787,522 | A | 8/1998 | Swihart | | |
| 6,082,805 | A | 7/2000 | Gray et al. | | |
| 6,163,900 | A | 12/2000 | Stevenson | | |
| 6,367,873 | B1 * | 4/2002 | Dorner et al. | 297/110 | |
| 6,588,837 | B1 * | 7/2003 | Schultz et al. | 297/111 | |
| 6,739,651 | B1 * | 5/2004 | Barefoot | 297/118 | |
| 7,188,379 | B2 | 3/2007 | James et al. | | |
| 8,739,330 | B2 * | 6/2014 | Smith | A47C 17/165 | 5/17 |
| 2003/0061655 | A1 | 4/2003 | Swihart et al. | | |
| 2005/0052067 | A1 * | 3/2005 | Grimm et al. | 297/423.2 | |
| 2013/0191989 | A1 | 8/2013 | Smith et al. | | |

* cited by examiner

CONVERTIBLE SEAT/BED HAVING NONCOPLANAR BED BASE SECTIONS

CROSS-REFERENCE TO RELATED APPLICATIONS

The present application claims priority to U.S. provisional application 61/828,450, filed May 29, 2013, entitled Extendable and Flip-Over Convertible Seat, incorporated herein by reference in its entirety. This application is also related to U.S. patent application Ser. No. 14/290,078 filed concurrently and commonly owned, and entitled "Extendable and Flip-Over Convertible Seat," which is also hereby incorporated by reference in its entirety.

BACKGROUND

1. Technical Field

The present invention pertains to the field of convertible seats, and more specifically, to convertible seats that provide a comfortable lying surface for a user.

2. Background of the Invention

Seating units (e.g., sofas, chairs, etc.) that are convertible into beds are popular with consumers because of their multi-functionality. Many consumers find it very convenient to have a seating unit that can provide a bed for a guest; as such a unit can eliminate the need for an additional, separate bed. Some such seating unit designs include their own complete mattress that is folded within a cavity of the sofa or chair during periods of non-use. This type of sofa-bed can be quite heavy, and typically requires not only a separate mattress, but also a relatively intricate mechanism to control the unfolding and folding of the mattress.

Other sofa-beds lack a complete mattress, but instead are constructed of separate sections that serve as support surfaces of the sofa or chair and unfold to form a flat, mattress-like lying/sleeping surface. Such a sofa-bed includes a backrest, a seat and a "subseat" that unfold to form a horizontal lying surface. In the folded "chair" configuration, the backrest is generally upright, and the seat and "subseat" fold upon each other (with the subseat in an inverted position). The backrest is guided between positions by preformed slots in the arms of the sofa that receive posts that extend laterally from the backrest. The backrest is coupled to the seat and subseat via an angled link. The subseat is pivotally attached at one end to the arms and is hinged at the other end to the seat.

Convertible beds are popular in health care environments (e.g., hospitals), because they provide a family member visiting a patient with a furniture piece in the patient's room on which one can sit, lie down on, or sleep. Because hospital rooms are typically short on available space, convertible beds used in hospital rooms are typically the width of a chair. Such beds may also be used in recreational vehicles. Generally speaking, such beds are designed with compactness and ease of conversion as their primary features, with little to no regard for the comfort of the user. An example of such configuration is illustrated in FIGS. 1A and 1B. FIG. 1A is a perspective view of a convertible chair 10 shown in the folded or chair configuration. FIG. 1B is a side section view of the convertible chair 10 shown in the unfolded (i.e., bed) configuration.

BRIEF SUMMARY OF THE INVENTION

Disclosed are embodiments of a seating unit convertible between a seating configuration and a sleeping configuration. In a version, the seating unit may include a base configured to rest on an underlying surface, a back frame pivotally connected to the base, a back deck connected to the back frame, a mid-frame pivotally connected to the base, a mid-deck connected to the mid-frame, a seat frame pivotally connected to the mid-frame, and a seat deck connected to the seat frame. In the sleeping configuration the mid-deck may lie within a first horizontal plane, the back deck may lie within a second horizontal plane, and the seat deck may lie within a third horizontal plane. The first horizontal plane may be at a first elevation, the second horizontal plane may be at a second elevation which is lower than the first elevation, and the third horizontal plane may be at a third elevation which is lower than the second elevation. The vertical distance between the first and second horizontal planes may be less than a vertical distance between the first and third horizontal planes.

The seating unit may further include a first cushion connected to the back deck, a second cushion connected to the mid-deck, and a third cushion connected to the seat deck. In the sleeping configuration the first cushion may have a relative vertical thickness that is greater than a vertical thickness of the second cushion and less than a vertical thickness of the third cushion. A crest of the first cushion, a crest of the second cushion, and a crest of the third cushion may all lie within a fourth horizontal plane. Further, respective sleeping surfaces of the first, second, and third cushions may be arcuate. In the sleeping configuration, the vertical thickness of the third cushion may be greater than the vertical thicknesses of the first and second cushions. Also, in the seating configuration the mid-deck and second cushion may be folded under the seat deck and third cushion.

DETAILED DESCRIPTION OF THE INVENTION

Figure 1A:
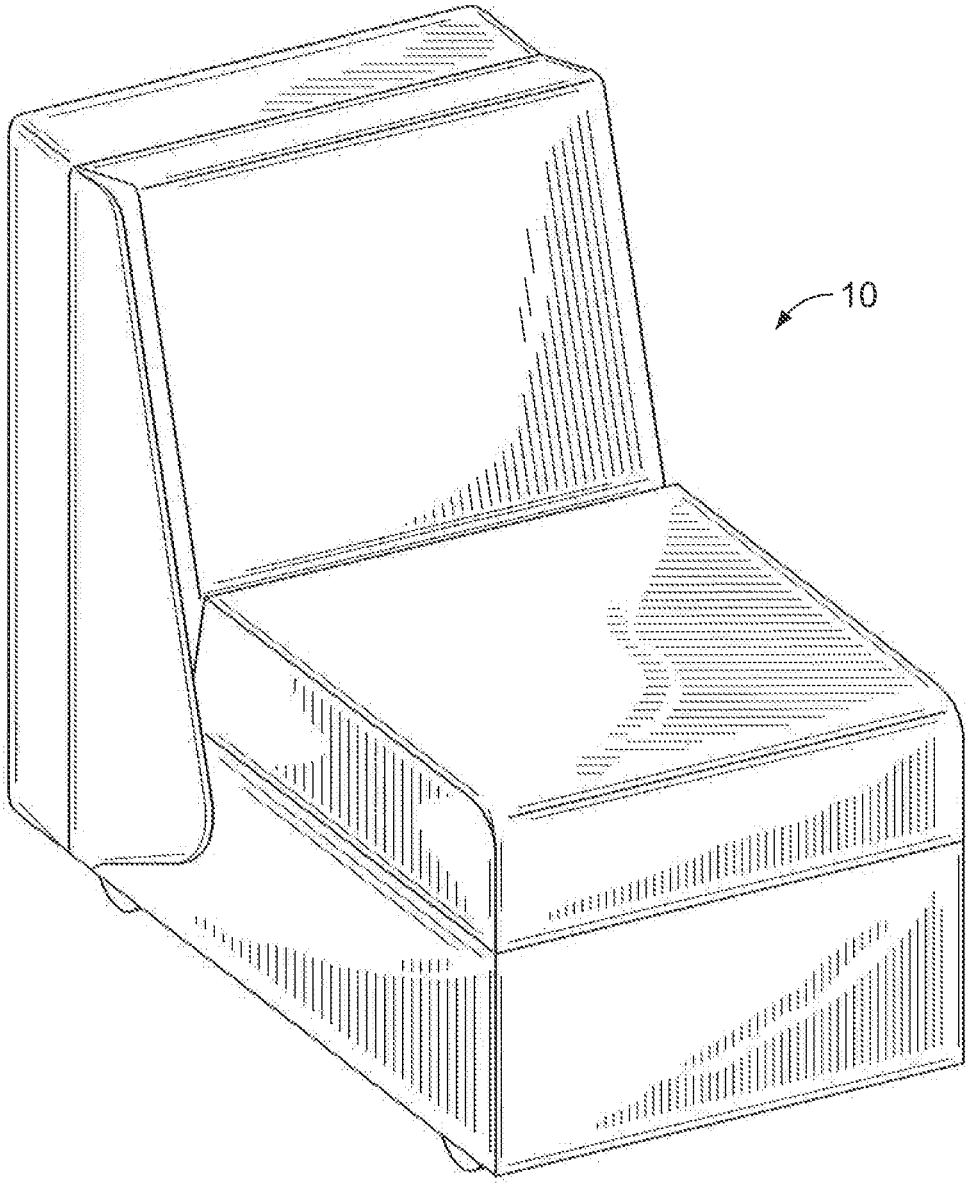
FIG. 1A PRIOR ART
FIG. 1A is a perspective view of a convertible chair of the prior art with the bed shown in the folded/chair configuration.
Figure 1B:
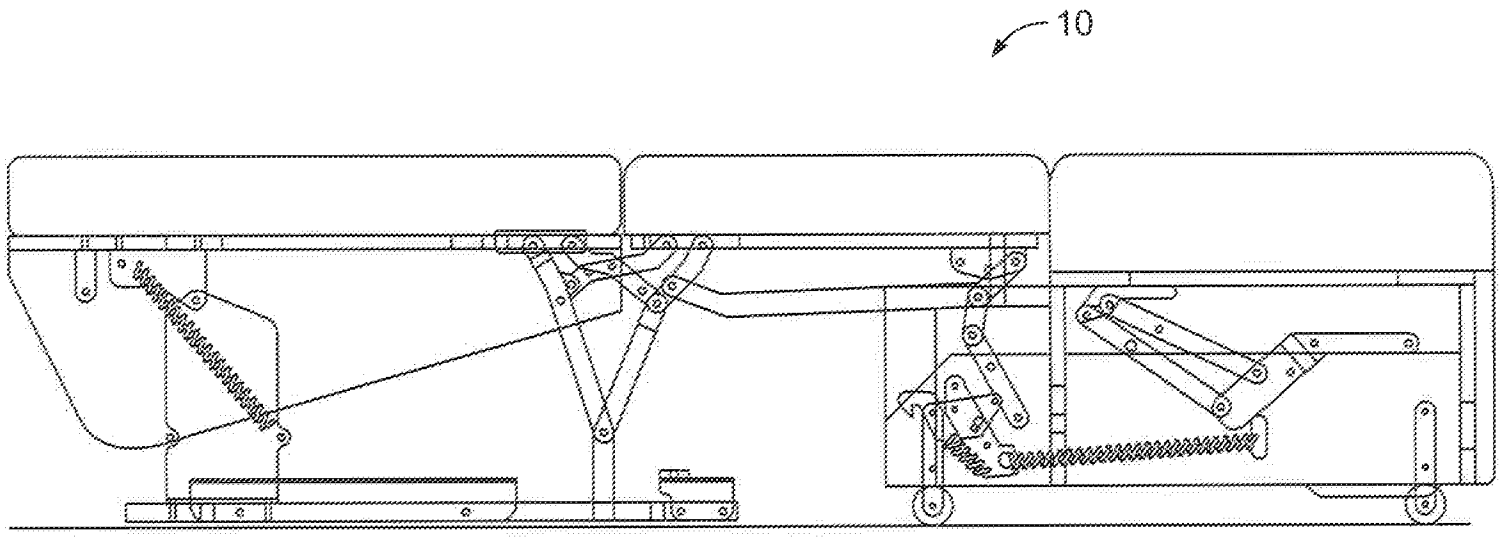
FIG. 1B PRIOR ART
FIG. 1B is a side section view of the convertible chair of FIG. 1A shown in the unfolded/sleeper configuration.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

By way of introduction, a convertible seat is adapted for use in applications from recreational vehicles to healthcare, commercial and residential applications. The convertible seat (hereinafter sometimes referred to as "mechanism" or "unit") reduces the number of steps required to position the unit from the chair/seat configuration to a bed/sleeper configuration. The convertible seat consists of seat and mid seat sections that are attached via a set of articulating linkage which, when the seat front is lifted and pulled up/outward, begin to extend and position support legs without secondary motion by the user. Once the legs of the now extended seat are supported by the floor the back section is rotated forward, completing conversion of the mechanism from the seat to the bed configuration.

An extendable and flip-over convertible seat has a base, a back frame, a seat frame, a mid-seat frame and linkage operatively connecting the frames to one another. The back frame is pivotally connected to the base so that it rotates from a seat configuration aligned slightly back from vertical, to a bed configuration in which the top is pulled forward to a horizontal position, whereby the back of the back frame (corresponding to the seat configuration) is now flat and upwardly facing.

Cross members are affixed to the respective frames so as to complete a seat deck, mid-seat deck and back deck. The seat frame and the mid-seat frame are pivotally connected to one another such that in a seat configuration the seat deck has the mid-seat deck folded thereunder.

Preferably, when the seat deck and mid-seat deck are folded and in the seat configuration the seat deck positively engages and locks the back deck.

In order to convert to a bed configuration in which the seat deck and the mid-seat deck form an extended first bed assembly (i.e., in use to support a person's trunk and legs), the seat deck is lifted up by its front edge and then frontwardly extended to an intermediate position. The linkage moves the mid-seat deck from an unseen location below the seat deck to an exposed, substantially horizontal orientation.

A support leg, or preferably a pair, are pivotally connected to the front edge of the seat deck and connected by a link mechanism to the base frame whereby the legs transition from a folded position to an extended position simultaneously as the first bed assembly (the seat deck and mid-seat deck combination) is extended to and through the intermediate position and then downward to the bed configuration. The leg(s) support the front edge in the bed configuration. This articulating leg/linkage assembly reduces the number of operations required by a user to convert the convertible seat from a seat configuration to a bed configuration as a mid-deck section emerges for underneath the seat deck. The mid-deck has a base that supports a cushion. In the bed configuration the mid-deck is within a plane that is non-coplanar with the extended seat deck and back deck.

The back deck has a seat back surface facing frontward when in the seat configuration and a lying/sleeping surface opposite, facing rearward, when in the seat configuration. After extending the seat deck and mid-seat deck into the first bed assembly the back deck may be pivoted (top moved forward and down) from the seat position to the bed position. The seat back (frontwardly facing) surface faces downwardly and the sleeping surface (the back of the seat back when in the seat position) faces upwardly to define a second bed assembly. The first bed assembly and the second bed assembly complete the bed.

As described below, in order to adapt to compactness and seating comfort requirements and support for lying/sleeping wherein a person's mass is not evenly distributed, the decks, in the bed configuration are aligned at different heights—in different planes. The mid-seat deck is highest, the back deck slightly lower and the seat deck considerably lower. This also accommodates different thicknesses and densities in the respective seat cushions.

The relative heights of the decks and corresponding thicknesses of the cushions provide a unique and comfortable support surface for supporting a person's mass when lying on the bed. In the lying/sleeping configuration, a person's trunk is their center of mass and is, in a vast majority of bodily shapes, the heaviest part of the body. In an embodiment, with the unit in the lying/sleeping configuration (hereinafter referred to as the sleeping configuration, although not limited to use for just sleeping), the mid-seat deck is highest and its cushion thinnest (relative to those of the seat deck/cushion and back deck/cushion), to thereby provide a first robust support surface for a person lying on the bed. The back deck/cushion supports a person's upper torso, arms, and head (usually the second heaviest part of the body) to provide a second robust support surface for a person lying on the bed. And the seat deck/cushion supports a person's legs in the sleeping configuration and provides a comfortable support surface there for, as well as in conjunction with the thickest of the three cushions, a soft seating surface for the unit when in the seating configuration. In an embodiment, the cushion for the back deck is thinner than the cushion for the seat deck, but thicker than the cushion for the mid-seat deck.

The particular cushions are formed and arranged to provide advantageous and comfortable seating and sleeping surfaces. A cushion is mounted on the seating surface having a flat bottom on the deck and a top arcuate surface. A plane intersecting the crest of the cushion's arcuate surface defines a first plane. The mid-seat deck has a cushion that, when the seat is in the seating position, is unused, while in the sleeping position a person's center of mass may well rest on the mid-seat deck cushion. Thus, the mid-deck cushion has its own thickness and density with a flat bottom (in the sleeping position) and an arcuate top surface. In the sleeping configuration a plane intersecting the crest of the arcuate surface of the mid-seat deck cushion defines a second plane. Finally, the back deck sleeping surface has a third cushion having a flat bottom on the deck and an arcuate surface. A plane intersecting the crest of the arcuate surface of this cushion defines a third plane. The first, second, and third planes are co-planar, but the particular cushion thicknesses are, as described above, different.

The sleep surface of this bed unit has extra padding added and is contoured in a manner that even with its thin profile, provides a comfortable sleep surface without the need for an air mattress, such as those required for like furniture. The sleep surface can be tailored in any material desired to meet customer expectations.

With the contour profile and extra padding added to the sleep surface the user is able to easily use the unit as a bed without the need for additional products, such as an air mattress. If desired, however, a user may also set an air mattress over the sleep surface.

The arcuate surfaces are preferably formed by affixation of a fabric or sheet material over an elastomeric material, such as a foam, which foam may be formed either as a curvilinear surface for the mid and back decks or as a pyramidal frustum for the seat. The combination of fabric and foam permits formation of the pyramidal frustum using combined planar surfaces, four angled and a fifth flat while the upholstery procedure of stretching the fabric or sheet produces the final arcuate surface.

As can be seen in the drawings (discussed below) the cushions are formed so as to have extending flanges at the perimeters and additionally have filler pieces. These configurations provide a combination of properties including edge support and better fit on the respective frames. The cushions preferably cover the frames to avoid contact with a user and also reduce the occurrence of chaffing the bedding.

Figure 2B:
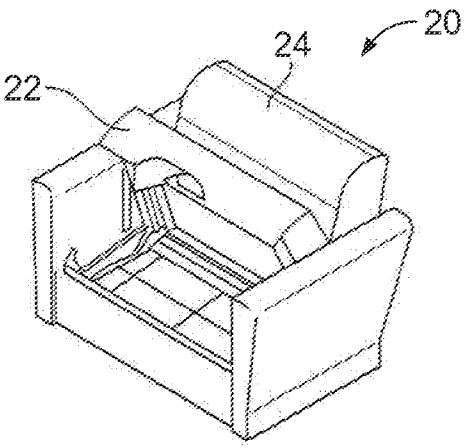
FIG. 2B is a perspective view of the convertible seat of FIG. 2A with its front being lifted from the seat configuration.
Figure 2D:
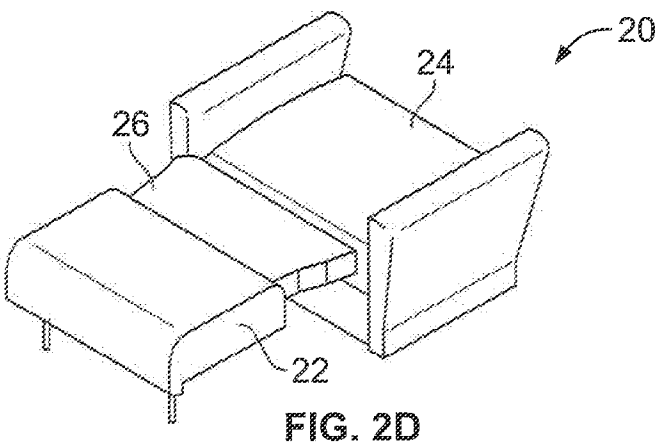
FIG. 2D is a perspective view of the convertible seat of FIG. 2A in a bed configuration.
Figure 2A:
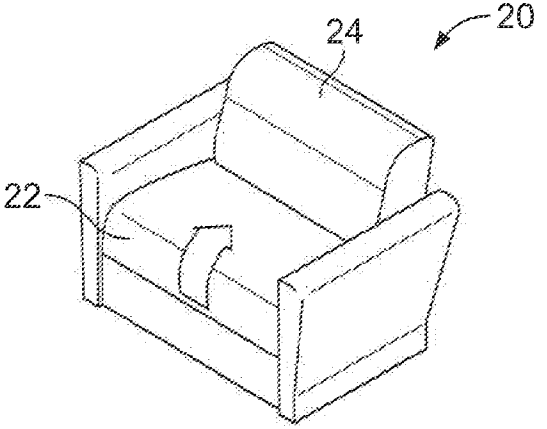
FIG. 2A is a perspective view of an embodiment of a convertible seat in its seat configuration.
Figure 2C:
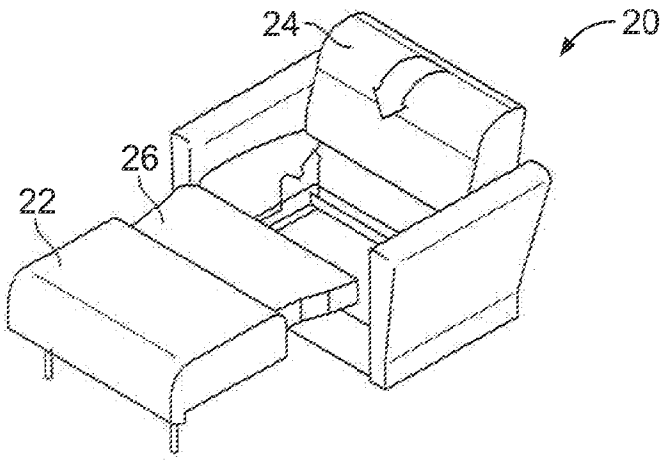
FIG. 2C is a perspective view of the convertible seat of FIG. 2A in an intermediate position.

Referring now to FIGS. 2A-2D, an embodiment of a convertible seat 20 is illustrated. The convertible seat 20 is illustrated in the seat (FIG. 2A), transitional (FIGS. 2B and 2C), and bed (FIG. 2D) configurations. The convertible seat 20 includes a seat 22, a back rest 24, and a mid-section 26. In order to convert the convertible seat 20 to a bed in which the seat 22 and mid-seat 26 form an extended first bed assembly, the seat 22 is lifted up by its front edge (illustrated in FIGS. 2A and 2B) and then frontwardly extended to an intermediate position (FIG. 2C). Linkage moves the mid-seat 26 from an unseen location below the seat 22 to an exposed, substantially horizontal orientation. The back 24 in the seat configuration (FIG. 2A) is aligned slightly back from vertical and is flipped forward to a bed configuration (FIG. 2D) in which the top is pulled forward to a horizontal position.

Figure 3:
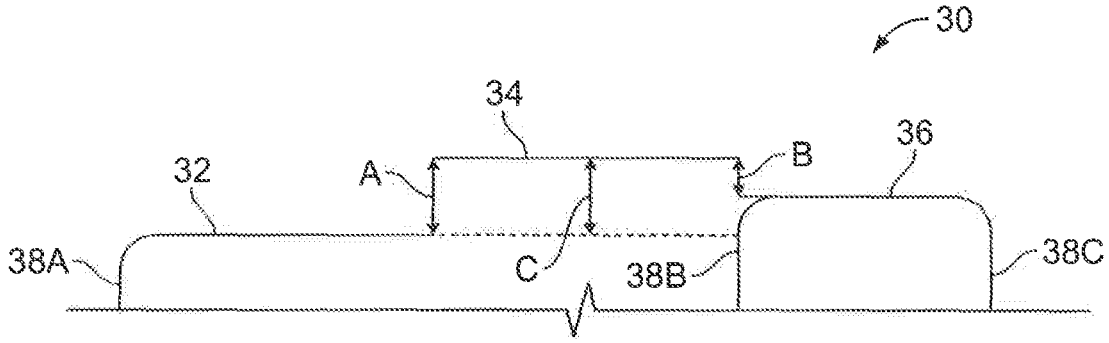
FIG. 3 illustrates an embodiment of noncoplanar deck sections of a convertible seat.
Figure 5:
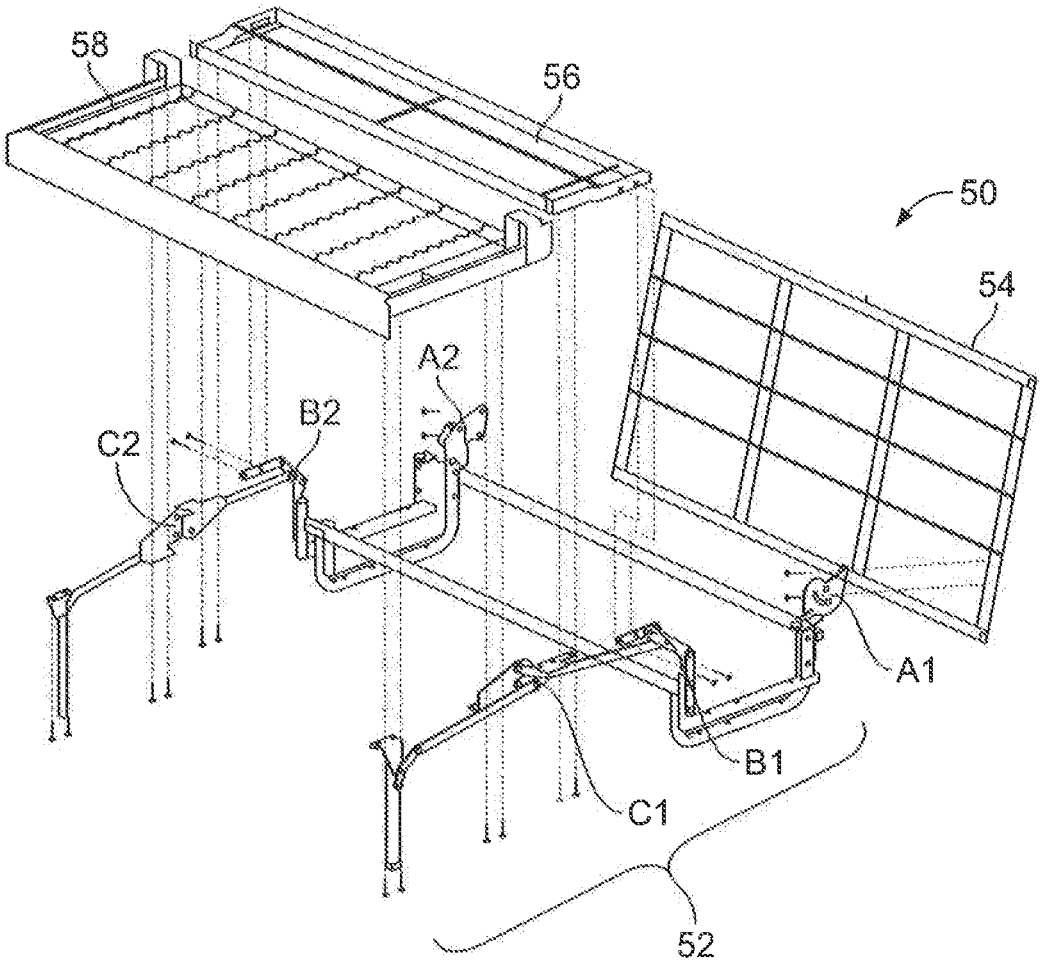
FIG. 5 is an exploded view of frame components of an embodiment of a convertible seat.

FIG. 3 illustrates an embodiment of deck sections 30 of a convertible seat in the sleeper configuration. The deck sections 30 may be provided in a convertible seat such as the one illustrated in FIGS. 2A-2D. The illustrated deck sections 30, or variations thereof, may be provided in other types and configurations of convertible chairs or sofas, as examples. In the bed configuration, the seat deck 32 is at a lowest relative elevation, the mid-deck 34 is at a highest relative elevation, and the back deck 36 is at an intermediate elevation. The decks are supported by a frame (an embodiment of which is illustrated in FIG. 5) having legs 38(A), 38(B), and 38(C). The seat deck 32 lies within a first plane, the mid-deck 34 lies within a second plane, and the back deck 36 lies within a third plane. A relative vertical distance between the three planes is represented by A, B, and C in FIG. 3.

Figure 4:
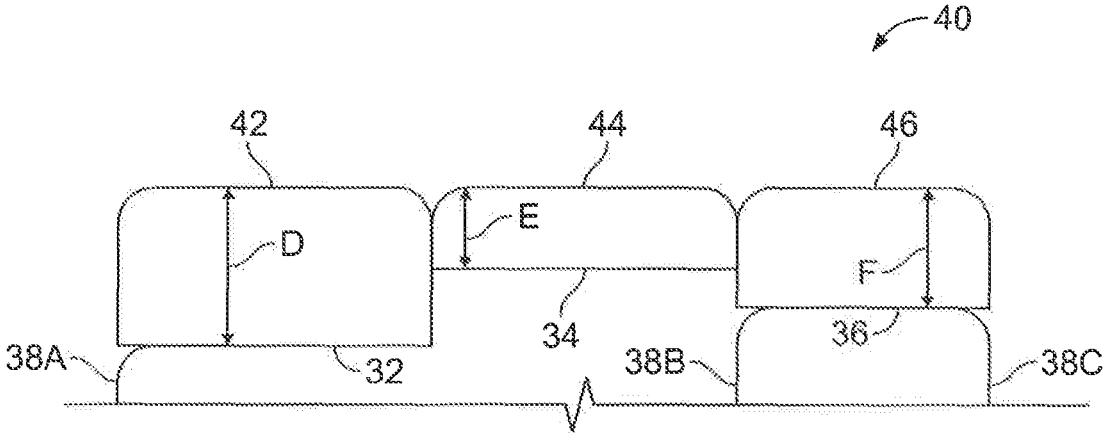
FIG. 4 illustrates an embodiment of cushions supported by the noncoplanar deck sections illustrated in FIG. 3.

FIG. 4 illustrates an embodiment of cushions supported by the deck sections, such as those illustrated in FIG. 3 as an example. A seat cushion 42 rests on or is fixed to the seat deck 32 and has a thickness represented by D. A mid-cushion 44 rests on or is fixed to the mid-deck 34 and has a thickness represented by E. A back cushion 46 rests on or is fixed to the back deck 36 and has a thickness represented by F. The thicknesses of the cushions 42, 44, and 46, in conjunction with the relative elevations of the decks 32, 34, and 36 provide a flat or substantially flat sleeping surface. Other embodiments are contemplated. For example, the thickness of the mid-cushion 44 may be slightly thicker than that illustrated in FIG. 4, providing additional or elevated lumbar support. In other embodiments, relative elevations of the decks and relative thicknesses of the cushions may be other than those illustrated.

FIG. 5 is an exploded view of frame components 50 of an embodiment of a convertible seat. The back frame 54 is shown upright (in the "seat" configuration) and pivots forward (corresponding to the movement illustrated in FIGS. 2C and 2D) about pivot points referred to as "A1" and "A2". The frame components 50 further include a base support assembly (also referred to as a base frame) 52, a mid-frame 56, and a seat frame 58. The back frame 54, mid-frame 56, and seat frame 58 may support a back deck, mid-deck, and a seat deck, respectively. Respective cushions may rest on or be fixed to the back deck, mid-deck, and seat deck (not shown). The illustrated embodiment of the base support assembly 52 includes frame elements, including linkage, that enable the convertible bed to transition between a chair and a bed, such as the conversion illustrated in FIGS. 2A to 20, as an example. The back frame 54, mid-frame 56, and seat frame 58 are supported by and attached to the base support assembly 52. The base support assembly 52 is configured to rest on an underlying surface, such as a floor.

In FIG. 5, the mid-frame 56 and the seat frame 58 are illustrated (as an exploded view) in the bed configuration (for example, corresponding to the convertible chair of FIGS. 2C and 2D). In the bed configuration, having the back frame 54 rotated forward and down, the base support assembly 52 supports the mid-frame 56, the back frame 54, and the seat frame 58 within highest, mid, and lowest planes, respectively, corresponding to the heights of the decks illustrated in FIG. 3, as an example. The bed is converted into a seat by rotating the back frame 54 up and back, into the illustrated position, and lifting seat frame 58, causing the mid-frame 56 to pivot up and backwards (i.e., clockwise in the figure) about pivot points "B1" and "B2" as the mid-frame 56 flips under the seat frame 58 about points "C1" and "C2" (i.e., clockwise in the figure). The seat frame 58 is then urged into the seat configuration (corresponding to the movement illustrated by FIGS. 2C to 2B to 2A, as an example).

As discussed above, the particular cushions are formed and arranged to provide advantageous seating and sleeping surfaces. A back deck sleeping surface has a first cushion having a flat bottom on the deck and an arcuate surface. The back deck sleeping surface faces rearward when the back deck is set in the seating configuration.

Figure 6A:
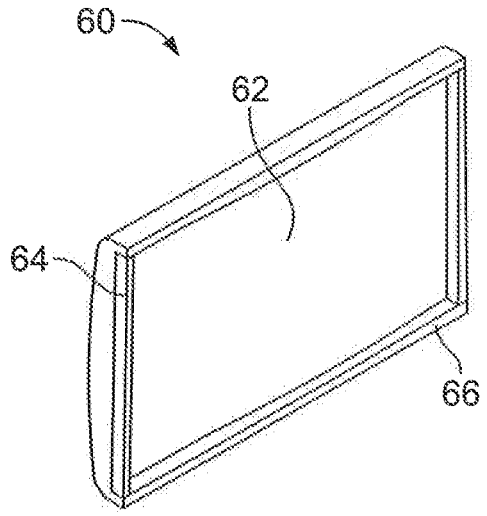
FIG. 6A is a rear perspective view of an embodiment of a back cushion assembly for a convertible seat.
Figure 6D:
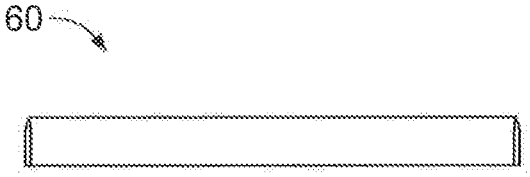
FIG. 6D is a top plan view of the back cushion assembly of FIG. 6A.
Figure 6C:
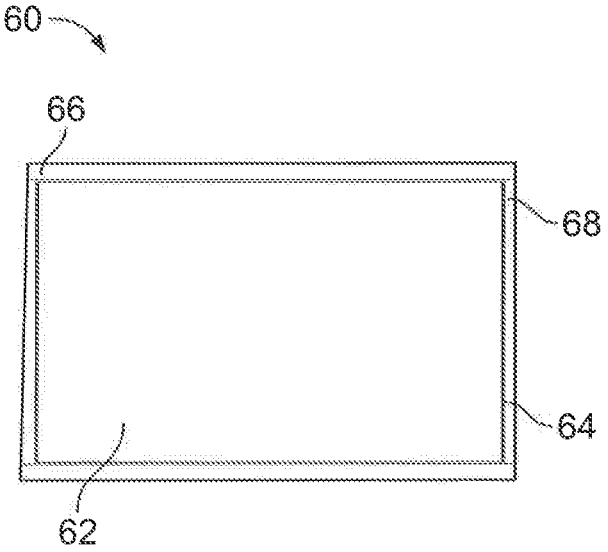
FIG. 6C is a rear elevational view of the back cushion assembly of FIG. 6A.
Figure 6B:
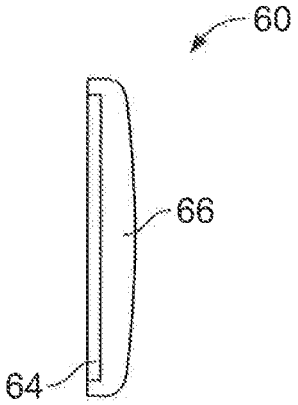
FIG. 6B is a side elevational view of the back cushion assembly of FIG. 6A.

FIG. 6A is a rear perspective view of an embodiment of a back cushion assembly 60 for a convertible seat. FIG. 6B is a side elevational view of the back cushion assembly 60. FIG. 6C is a rear elevational view of the back cushion assembly 60. And FIG. 6D is a top plan view of the back cushion assembly 60.

The back cushion assembly 60 preferably includes a backing 62, filler 64, a main taper 66, and a fillers taper 68. The back cushion assembly 60 preferably has an arcuate top/sleeping surface. With the convertible seat in the bed configuration, a first cushion plane intersects the crest of the arcuate surface of the back cushion assembly 60.

Figure 7A:
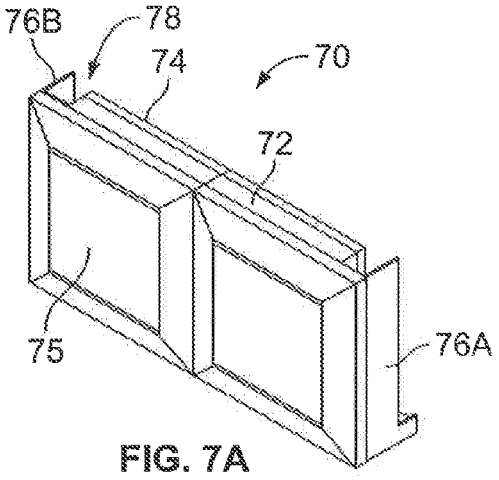
FIG. 7A is a top perspective view of an embodiment of a seat cushion assembly for a convertible seat.
Figure 7E:
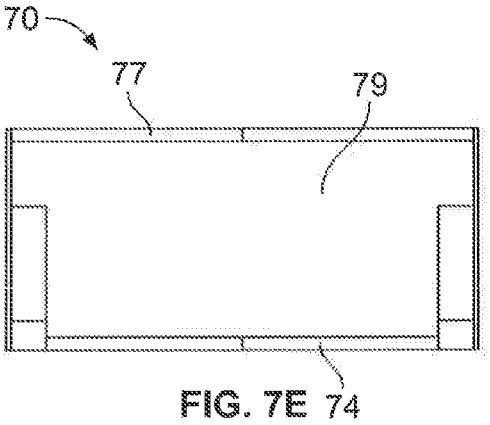
FIG. 7E is a bottom plan view of the seat cushion assembly of FIG. 7A.
Figure 7D:
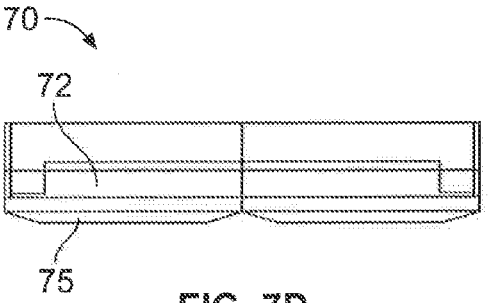
FIG. 7D is an inverted rear elevational view of the seat cushion assembly of FIG. 7A.
Figure 7C:
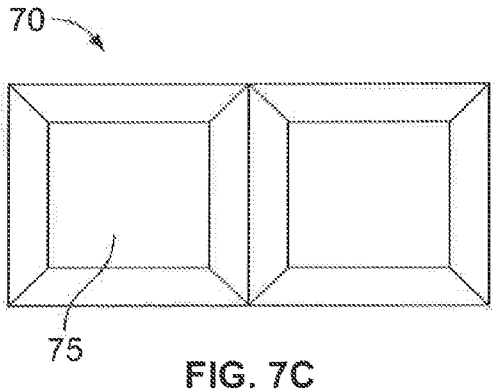
FIG. 7C is a top plan view of the seat cushion assembly of FIG. 7A.
Figure 7B:
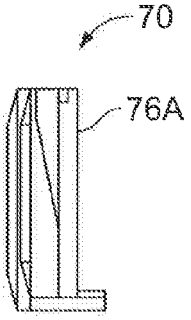
FIG. 7B is a side elevational view of the seat cushion assembly of FIG. 7A.

A cushion is mounted on the seating surface having a flat bottom on the deck and a top arcuate surface. FIG. 7A is a top perspective view of an embodiment of a seat cushion assembly 70 for a convertible seat. FIG. 7B is a side elevational view of the seat cushion assembly of FIG. 7A. FIG. 7C is a top plan view of the seat cushion assembly of FIG. 7A. FIG. 7D is an inverted rear elevational view of the seat cushion assembly of FIG. 7A. And FIG. 7E is a bottom plan view of the seat cushion assembly of FIG. 7A.

The seat cushion assembly 70 preferably includes a main body 72 between filler 74 and a top lam 75. The sides of the seat cushion assembly are defined by left and right side lams 76A and 76B. The seat cushion assembly 70 further includes backing 79 and a cut main poly 78. With the convertible seat in the bed configuration, a second cushion plane intersects the crest of the arcuate surface of the seat cushion assembly 70.

Figure 8A:
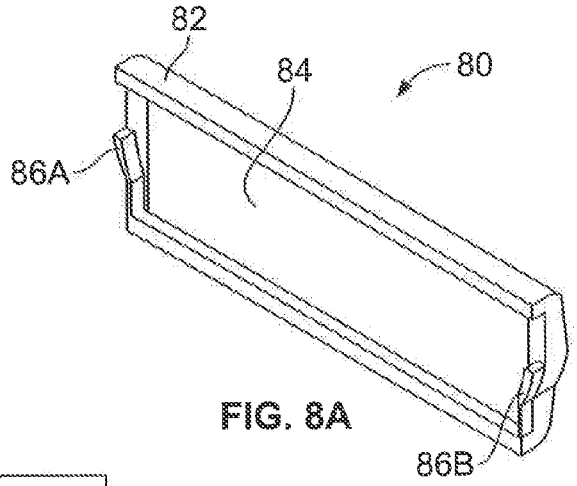
FIG. 8A is a rear perspective view of an embodiment of a mid-seat cushion assembly for a convertible seat.
Figure 8E:
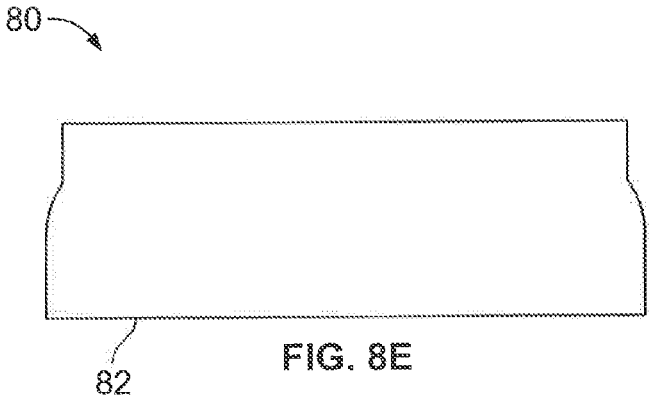
FIG. 8E is a front elevational view of the mid-seat cushion assembly of FIG. 8A.
Figure 8D:
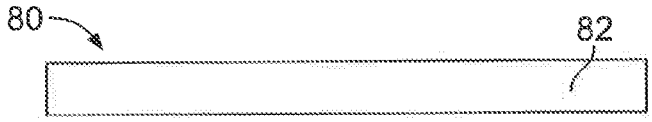
FIG. 8D is a top plan view of the mid-seat cushion assembly of FIG. 8A.
Figure 8C:
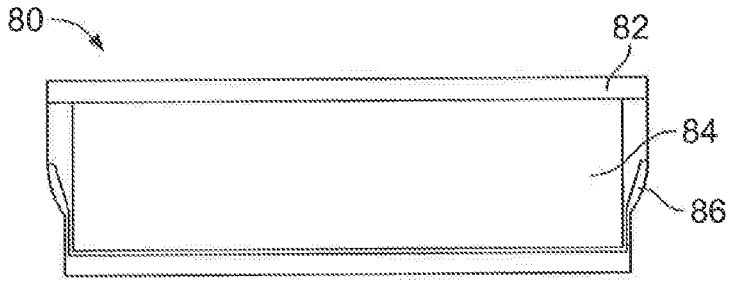
FIG. 8C is a rear elevational view of the mid-seat cushion assembly of FIG. 8A.
Figure 8B:
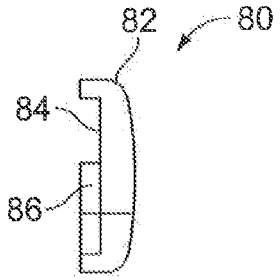
FIG. 8B is a side elevational view of the mid-seat cushion assembly of FIG. 8A.

The mid-seat deck has a cushion that, when the seat is in the seating position, is unused. In the sleeping position a person's center of mass may well rest on the mid-seat deck cushion. Thus, the cushion has its own thickness and density with a flat bottom and an arcuate top surface. FIG. 8A is a rear perspective view of an embodiment of a mid-seat cushion assembly 80 for a convertible seat. FIG. 8B is a side elevational view of the mid-seat cushion assembly 80 of FIG. 8A. FIG. 8C is a rear elevational view of the mid-seat cushion assembly 80 of FIG. 8A. FIG. 8D is a top plan view of the mid-seat cushion assembly 80 of FIG. 8A. And FIG. 8E is a front elevational view of the mid-seat cushion assembly 80 of FIG. 8A. The mid-seat cushion assembly preferably includes a main body 82, backing 84, and left and right lams 86A and 86B. With the convertible seat in the bed configuration, a third cushion plane intersects the crest of the arcuate surface.

Preferably, the first, second, and third cushion planes (corresponding to the base frames) are co-planar, but the particular arcuate surfaces and cushion thicknesses are different.

The arcuate surfaces of the cushions may be formed by affixation of a fabric or sheet material over an elastomeric material, such as foam, which foam may be formed either as a curvilinear surface, for the mid and back cushions, or as a pyramidal frustum for the seat cushion. The combination of fabric and foam permits formation of the pyramidal frustum using combined planar surfaces, four angled and a fifth flat while the upholstery procedure of stretching the fabric or sheet produces the final arcuate surface.

As illustrated in the drawings, the cushions may be formed so as to have extending flanges at the perimeters and additionally have filler pieces where shown. These configurations provide a combination of properties including edge support, better fit on the respective frames and covering the frames to avoid contact with persons and reduce chafe on bedding.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

I claim:

1. A seating unit convertible between a seating configuration and a sleeping configuration, the seating unit comprising:
- a base configured to rest on an underlying surface;
- a back frame pivotally connected to the base;
- a back deck connected to the back frame;
- a mid-frame pivotally connected to the base;
- a mid-deck connected to the mid-frame;
- a seat frame pivotally connected to the mid-frame; and
- a seat deck connected to the seat frame,
- wherein, in the sleeping configuration the mid-deck lies within a first horizontal plane, the back deck lies within a second horizontal plane, and the seat deck lies within a third horizontal plane, and wherein the first horizontal plane is at a first elevation, the second horizontal plane is at a second elevation which is lower than the first elevation, and the third horizontal plane is at a third elevation which is lower than the second elevation.

2. The seating unit of claim 1, wherein a vertical distance between the first and second horizontal planes is less than a vertical distance between the first and third horizontal planes.

3. The seating unit of claim 1 further comprising:
- a first cushion connected to the back deck;
- a second cushion connected to the mid-deck; and
- a third cushion connected to the seat deck,
- wherein, in the sleeping configuration the first cushion has a relative vertical thickness that is greater than a vertical thickness of the second cushion and less than a vertical thickness of the third cushion.

4. The seating unit of claim 3 wherein a crest of the first cushion, a crest of the second cushion, and a crest of the third cushion all lie within a fourth horizontal plane.

5. The seating unit of claim 3 wherein respective sleeping surfaces of the first, second, and third cushions are arcuate.

6. The seating unit of claim 3 wherein, in the sleeping configuration, the vertical thickness of the third cushion is greater than the vertical thicknesses of the first and second cushions.

7. The seating unit of claim 3 wherein in the seating configuration the mid-deck and second cushion are folded under the seat deck and third cushion.

8. The seating unit of claim 1, wherein, in the seating position:

the back frame and back deck are upright and the mid-deck and mid-frame are positioned below the seat deck and the seat frame.

9. The seating unit of claim 8, wherein:

the back frame rotates forward about a first pivot point where the back frame is pivotally connected to the base when converting the seating unit from the seating configuration to the sleeping configuration, such that the back deck lies within the second horizontal position in the sleeping configuration;

the mid-frame rotates up and forward about a second pivot point where the mid-frame is pivotally connected to the base when converting the seating unit from the seating configuration to the sleeping configuration, such that the mid-deck lies within the first horizontal plane in the sleeping position; and the seat frame rotates about a third pivot point where the seat frame is pivotally connected to the mid-frame, such that the seat deck lies within the third horizontal plane in the sleeping position.

10. A seating unit convertible between a seating configuration and a sleeping configuration, the seating unit comprising, in the sleeping configuration:

a horizontal mid-deck lying within a first horizontal plane;

a horizontal back deck lying within a second horizontal plane; and a horizontal seat deck lying within a third horizontal plane, and wherein the first horizontal plane is at a first elevation, the second horizontal plane is at a second elevation which is lower than the first elevation, and the third horizontal plane is at a third elevation which is lower than the second elevation.

11. The seating unit of claim 10 further comprising:

a first cushion connected to the back deck;

a second cushion connected to the mid-deck; and a third cushion connected to the seat deck, wherein, in the sleeping configuration the first cushion has a relative vertical thickness that is greater than a vertical thickness of the second cushion and less than a vertical thickness of the third cushion.

12. The seating unit of claim 11 wherein in the seating configuration the mid-deck is located beneath the third cushion.

13. The seating unit of claim 11 wherein the third cushion comprises an arcuate surface in both the seating and sleeping configurations.

14. The seating unit of claim 11 wherein, in the sleeping configuration, the vertical thickness of the third cushion is greater than the vertical thicknesses of the first and second cushions.

15. The seating unit of claim 14 wherein a crest of the first cushion, a crest of the second cushion, and a crest of the third cushion all lie within a fourth horizontal plane.

16. The seating unit of claim 10 further comprising:

a base configured to rest on an underlying surface; and a back frame pivotally connected to the base, wherein the back frame is rotatable about at least one pivot point to rotate from a seating position aligned slightly back from vertical, to a sleeping position in which the back frame is in a horizontal orientation.

* * * * *